US010308326B2

(12) United States Patent
Oh et al.

(10) Patent No.: US 10,308,326 B2
(45) Date of Patent: Jun. 4, 2019

(54) LNG TANK CONTAINER TRANSPORT SHIP, AND TRANSPORT METHOD USING SAME

(71) Applicant: KOREA GAS CORPORATION, Daegu (KR)

(72) Inventors: Young Sam Oh, Incheon (KR); So Jin Park, Ansan-si (KR); Kyoung Shik Choi, Ansan-si (KR)

(73) Assignee: KOREA GAS CORPORATION, Daegu (KR)

( * ) Notice: Subject to any disclaimer, the term of this patent is extended or adjusted under 35 U.S.C. 154(b) by 0 days.

(21) Appl. No.: 15/555,460

(22) PCT Filed: Jun. 18, 2015

(86) PCT No.: PCT/KR2015/006205
§ 371 (c)(1),
(2) Date: Sep. 1, 2017

(87) PCT Pub. No.: WO2016/140404
PCT Pub. Date: Sep. 9, 2016

(65) Prior Publication Data

US 2018/0037302 A1 Feb. 8, 2018

(30) Foreign Application Priority Data

Mar. 3, 2015 (KR) ..... 10-2015-0029870

(51) Int. Cl.

| | |
|---|---|
| ***B63B 25/00*** | (2006.01) |
| ***B63B 27/10*** | (2006.01) |
| ***B63B 25/14*** | (2006.01) |
| ***B63B 25/22*** | (2006.01) |

(Continued)

(52) U.S. Cl.
CPC ..... *B63B 25/004* (2013.01); *B63B 25/008* (2013.01); *B63B 25/14* (2013.01);
(Continued)

(58) Field of Classification Search
CPC ..... B63B 25/02; B63B 25/22; B63B 25/24; B63B 27/10; B63B 27/30; B60P 7/12;
(Continued)

(56) References Cited

U.S. PATENT DOCUMENTS 3,591,023 A 7/1971 Allen
4,083,318 A * 4/1978 Verolme ..... B63B 25/12 114/74 A (Continued)

FOREIGN PATENT DOCUMENTS

DE 3402520 A1 8/1985
EP 2241499 A1 10/2010

(Continued)

OTHER PUBLICATIONS

Office Action of corresponding Russian Patent Application No. 2017134035/11(060089)—7 pages, (dated Apr. 10, 2018).

(Continued)

*Primary Examiner* — D Glenn Dayoan
*Assistant Examiner* — Sunsurraye Westbrook
(74) *Attorney, Agent, or Firm* — Knobbe Martens Olson & Bear LLP

(57) ABSTRACT

An LNG tank container transport ship, according to one embodiment of the present invention, which has a load space on the inside thereof, in which LNG tank containers storing liquefied natural gas are loaded, comprises: a crane which is arranged on the upper part of the load space so as to catch a container to be transported; at least one horizontal transport frame which guides the horizontal direction movement of the crane; and at least one vertical transport frame which is connected to the horizontal transport frame so as to guide the movement of the crane in the direction perpendicular to the horizontal transport frame. According to one embodiment of the present invention, there is an effect of providing a dedicated transport ship for LNG tank container transport
(Continued)

by having therein a separate load space so as to load LNG tank containers.

10 Claims, 11 Drawing Sheets

(51) Int. Cl.
*B63B 27/12* (2006.01)
*B63B 35/54* (2006.01)
*B63B 19/08* (2006.01)

(52) U.S. Cl.
CPC ..... *B63B 25/22* (2013.01); *B63B 27/10* (2013.01); *B63B 27/12* (2013.01); *B63B 35/54* (2013.01); *B63B 2019/083* (2013.01)

(58) Field of Classification Search
CPC ..... B60P 3/035; B60P 7/135; B60P 7/0823; B60P 7/065; B60P 7/08; B60P 3/055; B60P 7/0807; B61D 45/003; B61D 3/16; B61D 45/008; B61D 45/001
USPC ..... 410/47, 49, 155, 42, 87, 117, 77, 78, 88, 410/89, 91; 414/458, 460, 800, 809, 910, 414/498
See application file for complete search history.

(56) References Cited

U.S. PATENT DOCUMENTS 4,144,829 A * 3/1979 Conway ..... B63B 25/10 114/74 R
4,158,416 A 6/1979 Podesta
5,954,099 A * 9/1999 Princiotta ..... B60P 3/055 141/18
6,339,996 B1 * 1/2002 Campbell ..... B60P 3/2205 114/74 R
9,376,049 B2 * 6/2016 Campbell ..... B65B 3/04
2010/0018603 A1 * 1/2010 Adler ..... F17C 5/06 141/4
2015/0334921 A1 * 11/2015 Jahraus ..... A01D 90/08 410/47

FOREIGN PATENT DOCUMENTS

GB 1543002 A 3/1979
KR 10-0751567 B1 8/2007
KR 10-2011-0072523 A 6/2011
KR 10-2012-0126270 A 11/2012
KR 10-2014-0089133 A 7/2014
KR 10-1439253 B1 9/2014
RU 2013108549 A 9/2014
WO 2012/074584 A1 6/2012

OTHER PUBLICATIONS

International Search Report dated Jul. 21, 2015 of PCT/KR2015/006205 which is the parent application and its English translation—4 pages.
Extended European Search Report of corresponding Patent Application No. 15884070.2—7 pages (dated Oct. 8, 2018).

* cited by examiner

LNG TANK CONTAINER TRANSPORT SHIP, AND TRANSPORT METHOD USING SAME

CROSS-REFERENCE TO RELATED APPLICATION

This application claims the benefit of Korean Patent Application 10-2015-0029870, filed on Mar. 3, 2015, the entire disclosure of which is incorporated herein by reference.

TECHNICAL FIELD

The present invention relates to an LNG tank container transport ship and a transportation method using the same.

BACKGROUND ART

Natural gas is usually supplied to consumers by the following two methods: a method in which natural gas is directly supplied to consumers through natural gas pipelines and a method in which liquefied natural gas (LNG) is supplied to consumers by a tanker truck. The latter is commonly employed to supply natural gas to a remote site where natural gas pipelines are not installed.

However, this method has a problem in that it is necessary to install a separate stationary storage tank at the remote site and to periodically charge the stationary storage tank with LNG.

At present, the only way to supply LNG to an island area is to use an LNG bunker shuttle or LNG tank container. However, this method has a problem in that there is no ship dedicated to transporting LNG tank containers, and in that installation of dedicated cargo handling facilities in a dock and port maintenance are required, making the transportation process complicated and causing cost increase and deterioration in transport reliability.

DISCLOSURE

Technical Problem

It is an aspect of the present invention to provide an LNG tank container transport ship which includes an internal cargo compartment for loading LNG tank containers and equipment for conveying the LNG tank containers to a loading/unloading position in the cargo compartment and loading the LNG tank containers onto an external vehicle in the loading/unloading position and thus can transport the LNG tank containers using existing port facilities without a need to construct separate cargo handling facilities at the port, thereby enabling economical and efficient supply of LNG to an island area or the like, and a method for transporting LNG tank containers by sea using the same.

Technical Solution

In accordance with one aspect of the present invention, an LNG tank container transport ship includes: an internal cargo compartment for loading LNG tank containers containing LNG; a crane holding the container and moving the container upward or downward to transfer the container to a loading/unloading position in the cargo compartment; at least one primary conveying frame guiding the crane to move in a first direction on a horizontal plane; and at least one secondary conveying frame connected to the primary conveying frame and guiding the crane to move in a second direction on the horizontal plane, intersecting the first direction.

The crane may include: a holding unit holding the container; and a vertical drive unit coupled to the holding unit and vertically moving the held container.

The primary conveying frame may include a first primary conveying frame formed at one side of the cargo compartment and a second primary conveying frame formed at the other side of the cargo compartment to be spaced apart from and parallel to the first primary conveying frame, and the secondary conveying frame may include a first secondary conveying frame and a second secondary conveying frame spaced parallel to each other between the first primary conveying frame and the second primary conveying frame.

The crane may include a vertical drive unit coupled to the first secondary conveying frame and the second secondary conveying frame and vertically driving the crane. In addition, the crane may be moved in the second direction along the first secondary conveying frame and the second secondary conveying frame, and the first secondary conveying frame and the second secondary conveying frame may be moved in the first direction, intersecting the second direction, along the first primary conveying frame and the second primary conveying frame.

Each of the first primary conveying frame and the second primary conveying frame may include a protrusion plate inwardly protruding therefrom and a conveying rail formed on an upper surface of the protrusion plate, and each of the first secondary conveying frame and the second secondary conveying frame may include a roller formed at both ends thereof, wherein the roller may be seated on the conveying rail to be movable in the first direction along the first and second primary conveying frames.

The vertical drive unit may include a pulley to vertically drive the holding unit.

In accordance with another aspect of the present invention, a method for transporting LNG tank containers includes: moving a crane along a primary conveying frame formed in a first direction on a horizontal plane or a secondary conveying frame formed in a second direction intersecting the first direction to transfer the LNG tank containers in a cargo compartment for loading the LNG tank containers containing LNG; holding, by a holding unit of the crane, at least one LNG tank container in the cargo compartment; moving the held LNG tank container to a bed of an external vehicle placed in a loading/unloading position in the cargo compartment; and loading the held LNG tank container onto the bed of the external vehicle to be transported to the outside of a ship by the external vehicle.

The primary conveying frame may include a first primary conveying frame formed at one side of the cargo compartment and a second primary conveying frame formed at the other side of the cargo compartment to be spaced apart from and parallel to the first primary conveying frame, and the secondary conveying frame may include a first secondary conveying frame and a second secondary conveying frame spaced parallel to each other between the first primary conveying frame and the second primary conveying frame.

The crane may include a vertical drive unit coupled to the first secondary conveying frame and the second secondary conveying frame and vertically driving the crane. The crane may be moved in the second direction on a horizontal plane along the first secondary conveying frame and the second secondary conveying frame, and moved in the first direction on the same horizontal plane, intersecting the second direction, along the first primary conveying frame and the second primary conveying frame.

In the method, holding, by the holding unit of the crane, at least one LNG tank container in the cargo compartment may include: moving, by the vertical drive unit, the crane downward to hold the LNG tank container through the holding unit; and lifting up, by the vertical drive unit, the held container.

The vertical drive unit may include a pulley to vertically drive the holding unit.

The above and other aspects, features, and advantages of the present invention will become apparent from the detailed description of the following embodiments in conjunction with the accompanying drawings.

It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

Advantageous Effects

The present invention provides a ship dedicated to transportation of LNG tank containers which includes a separate internal cargo compartment for loading the LNG tank containers.

In addition, the invention provides an LNG tank container transport ship which includes an internal cargo compartment for LNG tank containers and an LNG tank container handling system for loading/unloading the LNG tank containers onto/from an external vehicle in the cargo compartment to allow transportation of LNG tank containers using existing port facilities without a need to construct separate cargo handling facilities at a port or to perform port maintenance, thereby reducing the economic burden of transporting LNG tank containers to an island or the like, while providing ease of loading/unloading to simplify a process of transferring LNG tank containers to the outside of the ship, thereby effectively reducing risk during transportation.

Further, the LNG tank containers are loaded onto or unloaded from an external vehicle put into the transport ship, thereby improving transportation reliability and effectively preventing accidents during transportation.

BEST MODE

Figure 1:
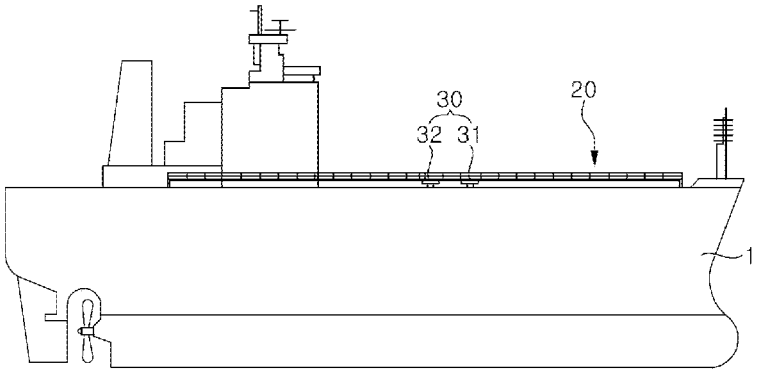
FIG. 1 is a schematic side view of an LNG tank container transport ship according to one embodiment of the present invention

The above and other aspects, features, and advantages of the present invention will become apparent from the detailed description of the following embodiments in conjunction with the accompanying drawings. It should be noted that like components will be denoted by like reference numerals throughout the specification and the accompanying drawings. In addition, it will be understood that, although the terms "first", "second", "one", "the other", etc. may be used herein to describe various elements, components, regions, layers and/or sections, these elements, components, regions, layers and/or sections should not be limited by these terms. In addition, descriptions of details apparent to those skilled in the art will be omitted for clarity.

Hereinafter, embodiments of the present invention will be described in detail with reference to the accompanying drawings.

Figure 2:
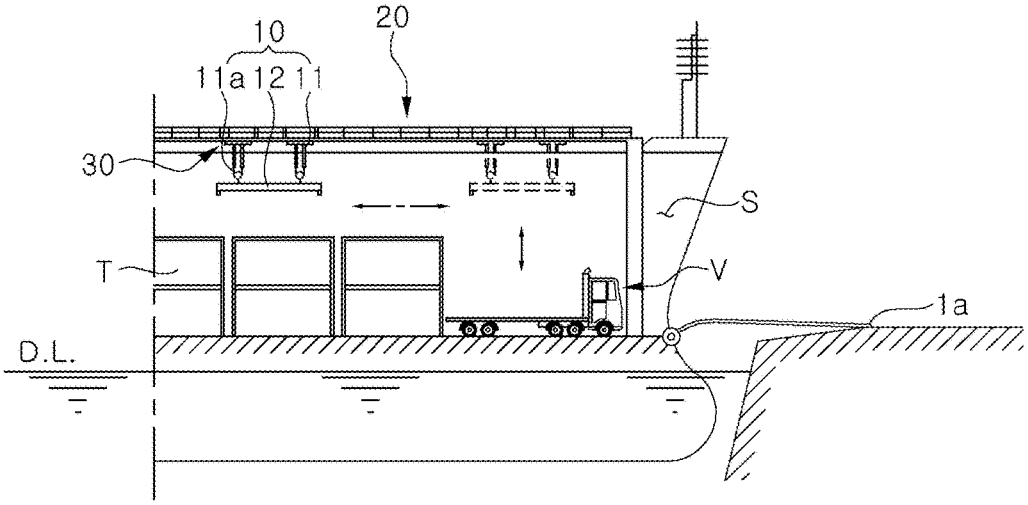
FIG. 2 is a schematic view of an internal cargo compartment system of the LNG tank container transport ship according to the embodiment of the present invention.
Figure 3:
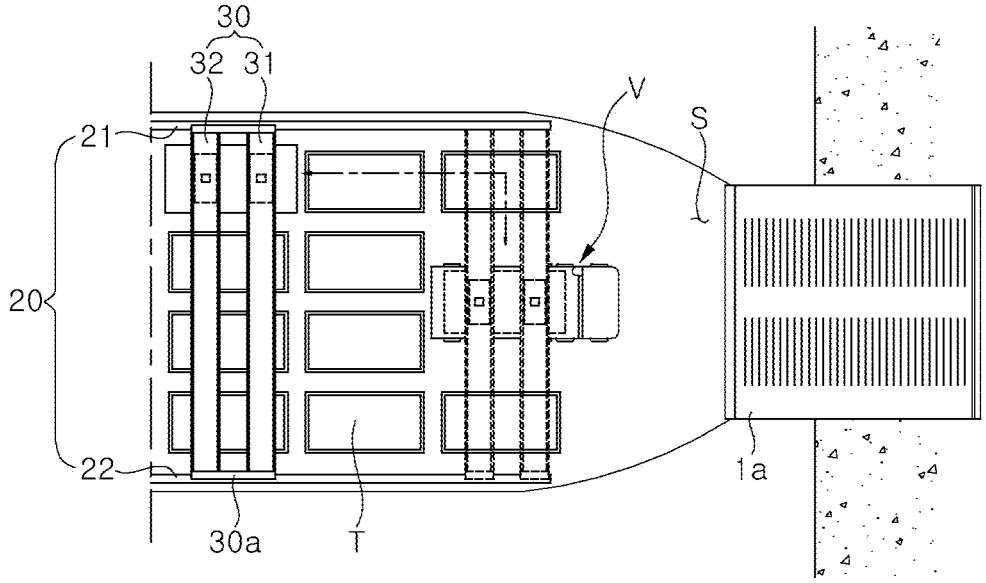
FIG. 3 is a plan view of the internal cargo compartment system of the LNG tank container transport ship according to the embodiment of the present invention.
Figure 4:
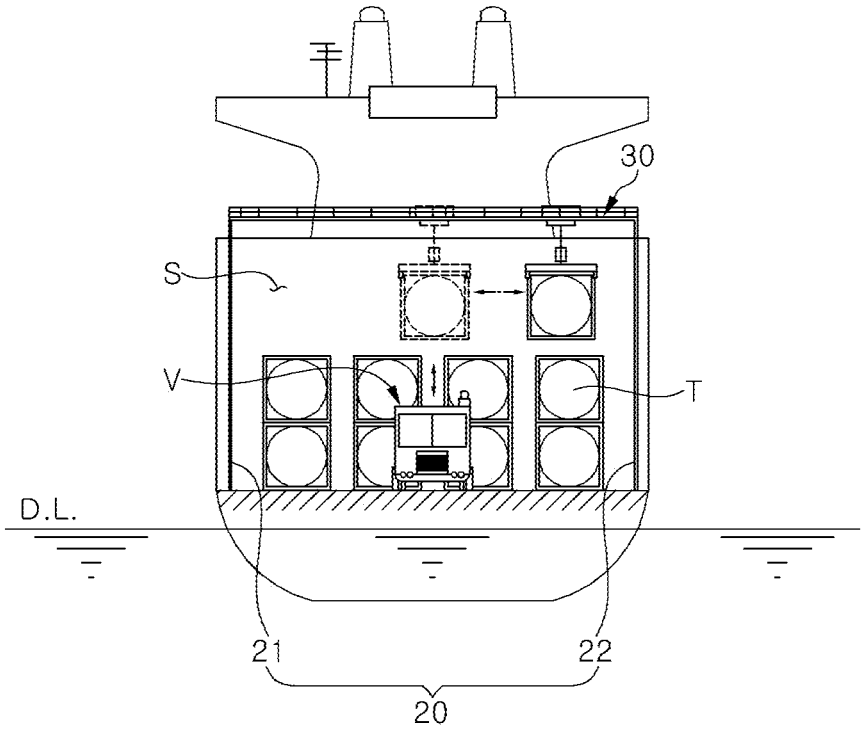
FIG. 4 is a front view of the internal cargo compartment system of the LNG tank container transport ship according to the present invention.

FIG. 1 is a schematic side view of an LNG tank container T transport ship 1 according to one embodiment of the present invention, FIG. 2 is a schematic view of an internal cargo compartment S system of the LNG tank container T transport ship 1 according to the embodiment of the present invention, FIG. 3 is a plan view of the internal cargo compartment S system of the LNG tank container T transport ship 1 according to the embodiment of the present invention, and FIG. 4 is a front view of the internal cargo compartment S system of the LNG tank container T transport ship 1 according to the present invention.

A liquefied natural gas (LNG) tank container T transport ship 1 according to one embodiment of the present invention includes: an internal cargo compartment for loading LNG tank containers containing LNG; a cargo door la coupled to a stem of the ship to open/close the cargo compartment; a crane 10 disposed in the cargo compartment and holding the containers to move the containers upward or downward and transfer the containers to a loading/unloading position in the cargo compartment; at least one primary conveying frame 20 formed at both sides of the top of the cargo compartment and guiding the crane 10 to move in a first direction, which is a direction of the stem of the ship on a horizontal plane; and at least one secondary conveying frame 30 connected to the primary conveying frame 20 and guiding the crane 10 to move in a second direction on the horizontal plane, intersecting the first direction.

The transport ship 1 according to this embodiment of the invention includes a separate cargo compartment S to allow the LNG tank containers T to be loaded in the cargo compartment S. That is, the cargo compartment S serves to carry the LNG tank containers T containing LNG. Although the LNG tank container T is described as an example herein, it should be understood that the present invention may be applied to the same or similar types of containers T.

Conventionally, in order to efficiently transport containers T loaded in a cargo compartment S of a transport ship 1 to an island or the like, dedicated cargo handling facilities at the dock and port equipment are required. However, this requirement causes problems of cost increase due to port maintenance, construction of the facilities, and the like, and deterioration in transportation reliability.

In this embodiment, the separate cargo compartment S is provided to the transport ship 1 and the containers T in the cargo compartment S are directly loaded onto a bed of an external vehicle V, such as a tractor, put into a loading/unloading area of the ship through the opened cargo door la and then transported to the outside, thereby eliminating the need for a complex cargo handling system. Further, using the system of the transport ship 1, the containers T can be efficiently loaded onto the vehicle or unloaded from the vehicle to be shipped even at a site where a space for installation of related facilities for transporting the containers T is limited, such as an island.

The crane 10 may include a vertical drive unit 11 configured to drive the crane in a vertical direction and a holding unit 12 coupled to the vertical drive unit 11 and holding the container. As the holding unit 12, a container spreader may be used. However, it should be understood that the present invention is not limited thereto and the holding unit may be any suitable device or means for holding containers.

The holding unit 12 approaches a target container T through operation of the vertical drive unit 11 and then stably holds the container T. After the holding unit 12 with the container held thereby is moved up by the vertical drive unit 11, the crane 10 is moved to an external vehicle V having been placed in a desired loading/unloading area to load the container onto the vehicle. The vertical drive unit 11 may include the holding unit 12 holding the container and a movement guide unit connected to the holding unit 12 and guiding vertical movement of the holding unit. Although the vertical drive unit 11 is shown as including a pulley 11 a and a chain-type movement guide unit herein, it should be understood that the present invention is not limited thereto and the vertical drive unit 11 may be configured in various ways.

As described above, the transport ship according to this embodiment includes at least one primary conveying frame 20 guiding the crane 10 to move in a first direction on a horizontal plane and at least one secondary conveying frame 30 coupled to the primary conveying frame 20 and guiding the crane to move in a second direction intersecting the first direction on the same horizontal plane. Herein, the first direction and the second direction may refer to any directions intersecting each other on the horizontal plane and may be respectively defined as an x-axis direction and a y-axis direction on a general two-dimensional plane. However, it is obvious to those skilled in the art that the first direction and the second direction may be designed in various ways in view of the movement radius and movement path of the crane 10.

Specifically, as shown in FIGS. 2 and 3, the transport ship 1 is provided at the top of the cargo compartment S with a system for moving and loading the containers T onto the external vehicle V. The crane 10 approaches a target container T based on a two-dimensional position of the container in the cargo compartment S, sensed or detected with a camera or the naked eye. Here, the crane 10 is moved to a desired position along the primary conveying frame 20 and secondary conveying frame 30. As described above, the at least one primary conveying frame 20 may be connected/coupled to the at least one secondary conveying frame 30 to control a wide range of movement of the crane 10 for holding the container in the cargo compartment. Although the structure and arrangement of the primary conveying frame 20 and secondary conveying frame 30 are shown in FIGS. 2 and 3, it should be understood that the present invention is not limited thereto.

Referring to FIG. 3, the crane 10 including the holding unit 12 holding the container T is formed at the top of the cargo compartment S, and the primary conveying frame 20 and the secondary conveying frame 30 are provided to guide the crane 10 to move in the first direction and the second direction on a horizontal plane, respectively.

That is, the at least one primary conveying frame 20 serves to guide the crane 10 to move in the first direction on a horizontal plane, and the at least one secondary conveying frame 30 is connected to the primary conveying frame 20 to guide the crane 10 to move in the second direction on the horizontal plane, intersecting the first direction.

Specifically, the primary conveying frame 20 may include a first primary conveying frame 21 and a second primary conveying frame 22 respectively formed at right and left ends of the cargo compartment to be spaced parallel to each other. Since both the first primary conveying frame 21 and the second primary conveying frame 22 serve to guide the crane to move in the first direction, the first primary conveying frame 21 and the second primary conveying frame 22 are arranged parallel to each other.

Referring to FIG. 4, the crane 10 may be coupled to a first secondary conveying frame 31 and a second secondary conveying frame 32. Specifically, the crane 10 is not fixedly coupled to the first and second secondary conveying frames 31, 32, and is connected to the first and second secondary conveying frames 31, 32 to be movable in the second direction, that is, in longitudinal directions of the first and second secondary conveying frames 31, 32.

In addition, as shown in FIG. 3, the crane 10 connected to the first and second secondary conveying frames is movable in longitudinal directions of the first and second primary conveying frames 21, 22 through a movable member 30*a* formed at both ends of each of the first and second secondary conveying frames 31, 32, such that movement of the crane 10 in the first direction can be guided.

Here, each of the first and second primary conveying frames 21, 22 includes a protrusion plate 20*a* inwardly protruding therefrom and a conveying rail 20*b* formed on the protrusion plate 20*a* to guide movement of the first and second secondary conveying frames 31, 32, such that the movable member 30*a* of each of the first and second secondary conveying frames 31, 32 can be moved forward or backward in the first direction along the conveying rail 20*b*. The movable member 30*a* may include a roller configured to be seated on the conveying rail 20*b*. Although the conveying rail 20*b* and the roller are used to guide movement of the movable member herein, it should be understood that any other suitable component or member may be used to allow the first and second secondary conveying frames 31, 32 to be movable forward or backward along the first and second primary conveying frames 21, 22.

The crane 10 is moved in the first and second directions on the horizontal plane along the primary conveying frame 20 and the secondary conveying frame 30, whereby the container held by the crane can be moved to a desired loading/unloading position and then stably placed on the external vehicle V waiting at the loading/unloading position, thereby facilitating transportation of the container.

Similarly, the LNG tank container can be transferred to the transport ship by the external vehicle V and then properly loaded in the cargo compartment in the transport ship to be shipped.

FIGS. 5 to 11 are views sequentially illustrating a transportation method using an LNG tank container T transport ship 1 according to one embodiment of the present invention.

Next, a method of transporting LNG tank containers according to one embodiment of the present invention will be described in detail with reference to the accompanying drawings.

The method of transporting LNG tank containers T according to this embodiment includes: opening a cargo door la coupled to a stem of the ship to open/close an internal cargo compartment for loading the LNG tank containers containing LNG; putting an external vehicle into the cargo compartment of the ship through the opened cargo door;

moving a crane 10 in a first direction on a horizontal plane, which is a direction of the stem of the ship, or a second direction on the horizontal plane, intersecting the first direction, along a primary conveying frame 20 formed in the first direction at both sides of an upper portion of the cargo compartment and a secondary conveying frame 30 formed in the second direction to hold at least one LNG tank container using a holding unit 12; moving the held LNG tank container to a bed of the external vehicle V in the cargo compartment; transporting the LNG tank container loaded onto the external vehicle V to the outside of the ship; and closing the cargo door la.

Figure 5:
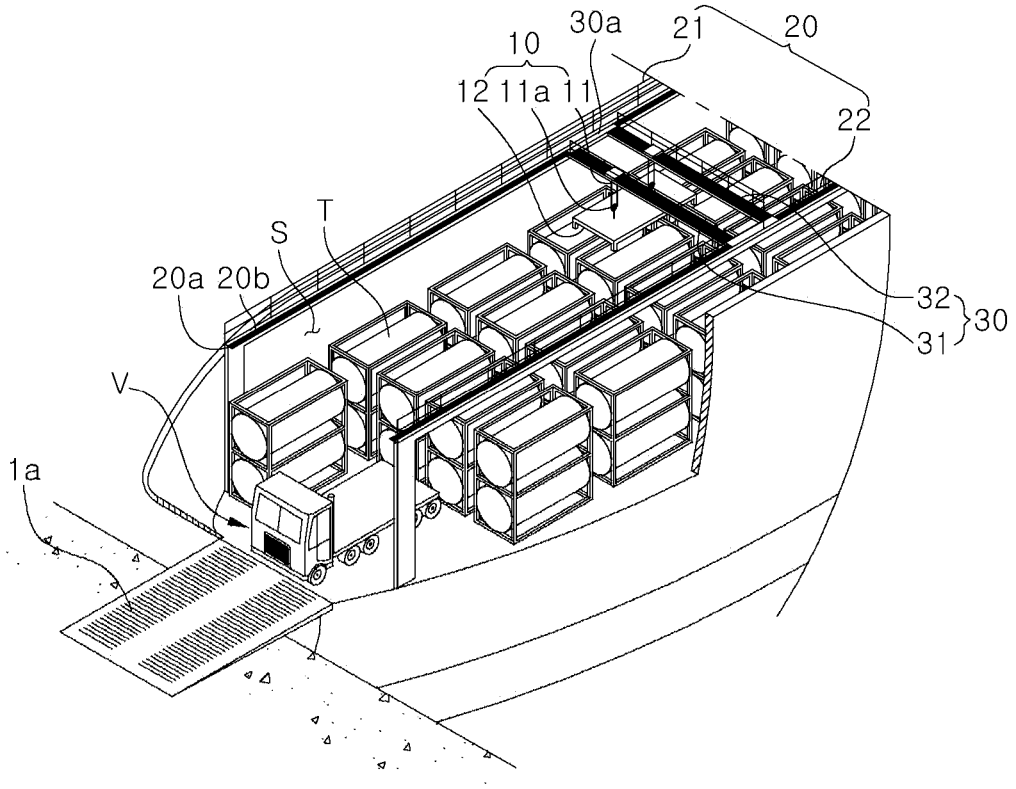
FIGS. 5 to 11 are views sequentially illustrating a transportation method using an LNG tank container transport ship according to one embodiment of the present invention.

Specifically, first, the cargo door la at the stem of the ship is opened and then the external vehicle V is put into a loading/unloading position in the cargo compartment of the ship through the opened cargo door, as shown in FIG. 5. Then, the crane is moved along the primary conveying frame 20 formed in the first direction on the horizontal plane or the secondary conveying frame 30 formed in the second direction, intersecting the first direction, to transfer the LNG tank container within the cargo compartment. Since the first direction and the second direction have already been described in the LNG tank container transport ship according to the present invention, detailed description thereof will be omitted.

Figure 6:
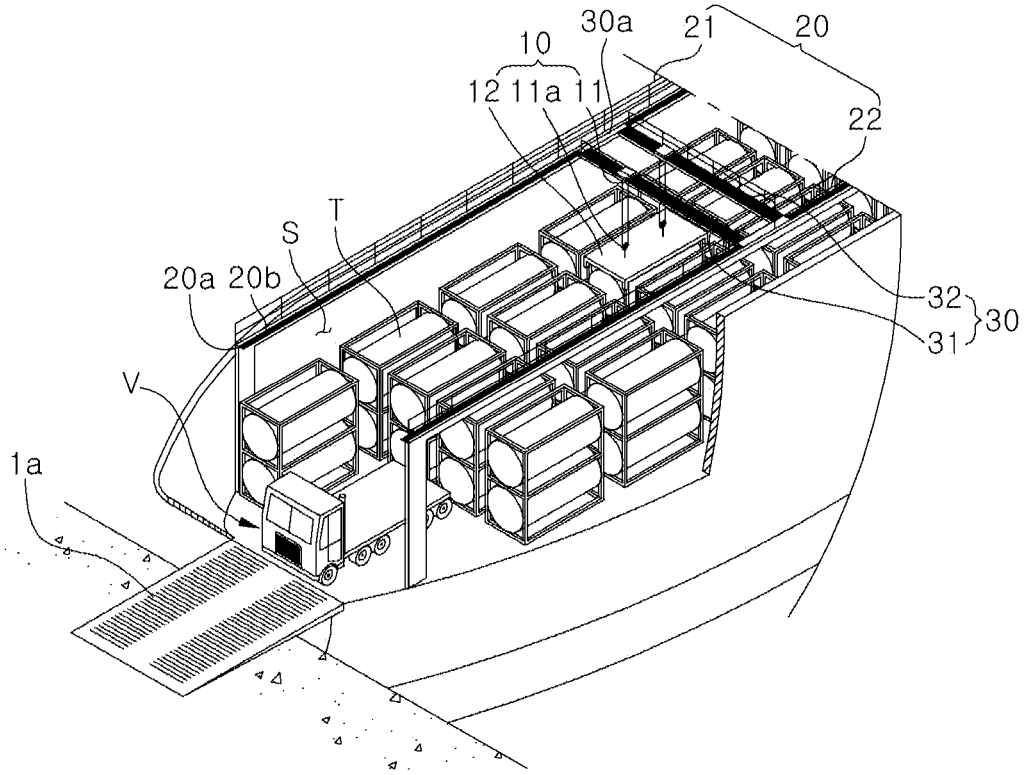

Then, the crane 10 above the container is moved toward a target container by a vertical drive unit 11 to allow the container to be held by the holding unit 12, as shown in FIG. 6. After the holding unit 12 stably holds the container, and a movement guide unit connected to the holding unit 12 lifts the container. As shown in the drawings, the movement guide unit includes a pulley 11*a* and a chain to move the container upward. Here, the container is preferably lifted up to the top of the cargo compartment to facilitate movement of the crane 10 with the container held thereby.

Figure 7:
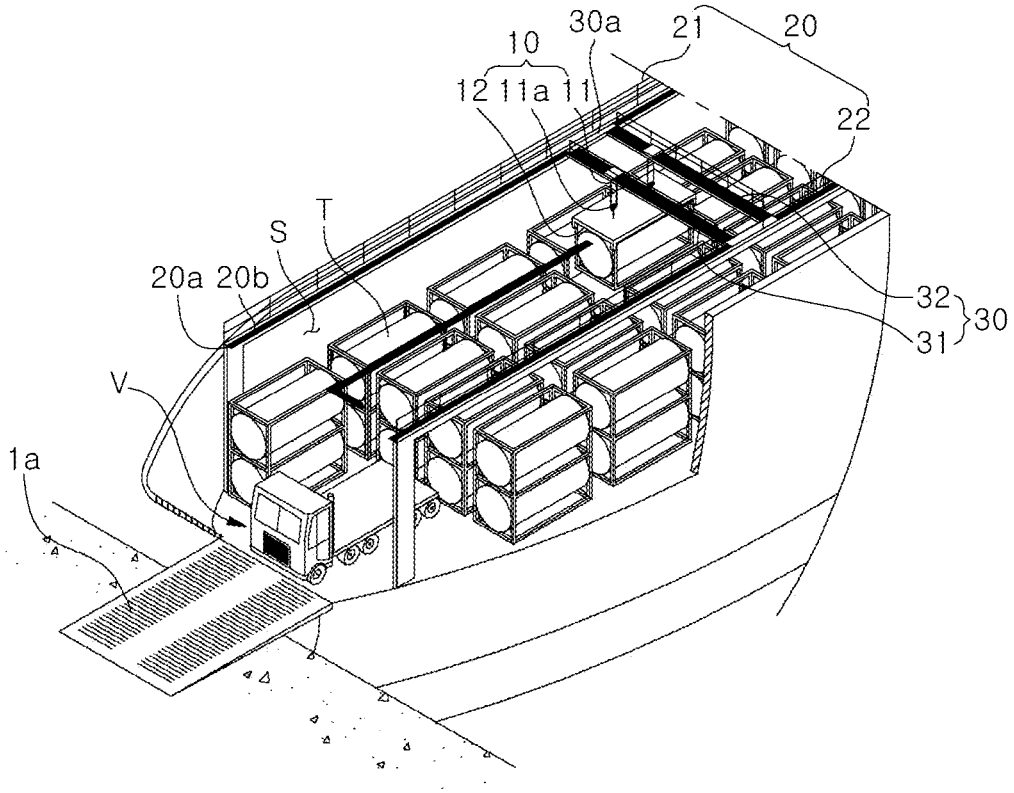

Then, the held LNG tank container is moved to the bed of the external vehicle V in the loading/unloading position in the cargo compartment, as shown in FIG. 7. Since the cargo compartment is provided therein with a separate loading/unloading position accommodating the external vehicle V, the external vehicle V can efficiently enter or exit the ship.

Figure 8:
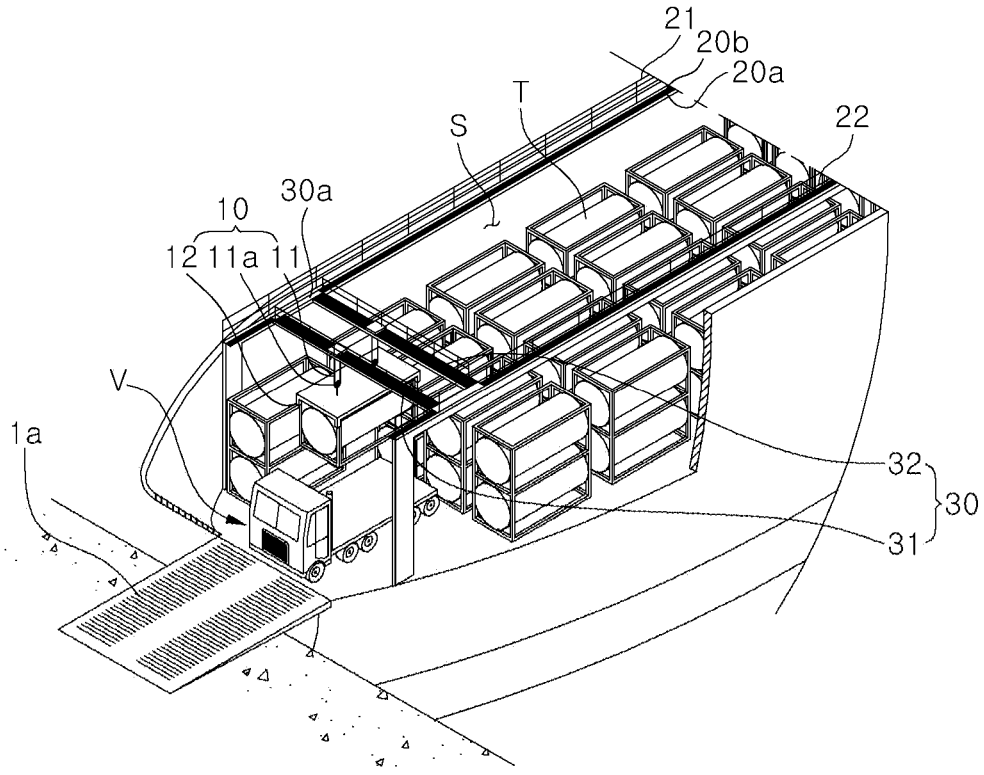
Figure 9:
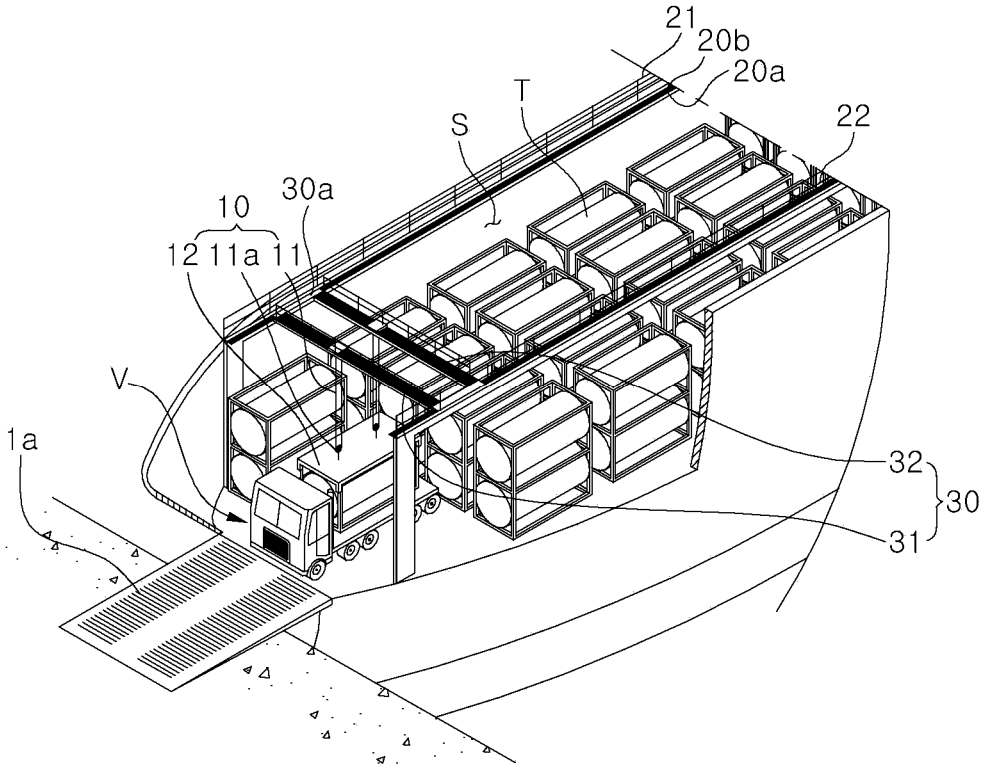

As shown in FIGS. 8 and 9, the crane 10 may be moved to the external vehicle V in the loading/unloading position in the ship along the primary conveying frame and the secondary-conveying frame and put down the container on the bed of the external vehicle V.

Conventionally, for external transfer of containers, separate cargo handling equipment, such as a reach stacker, is required or cargo handling facilities need to be provided at the port. However, according to the present invention, transportation of containers T can be easily achieved only with the unloading system of the transport ship 1 without using such separate cargo handling equipment or facilities.

Figure 10:
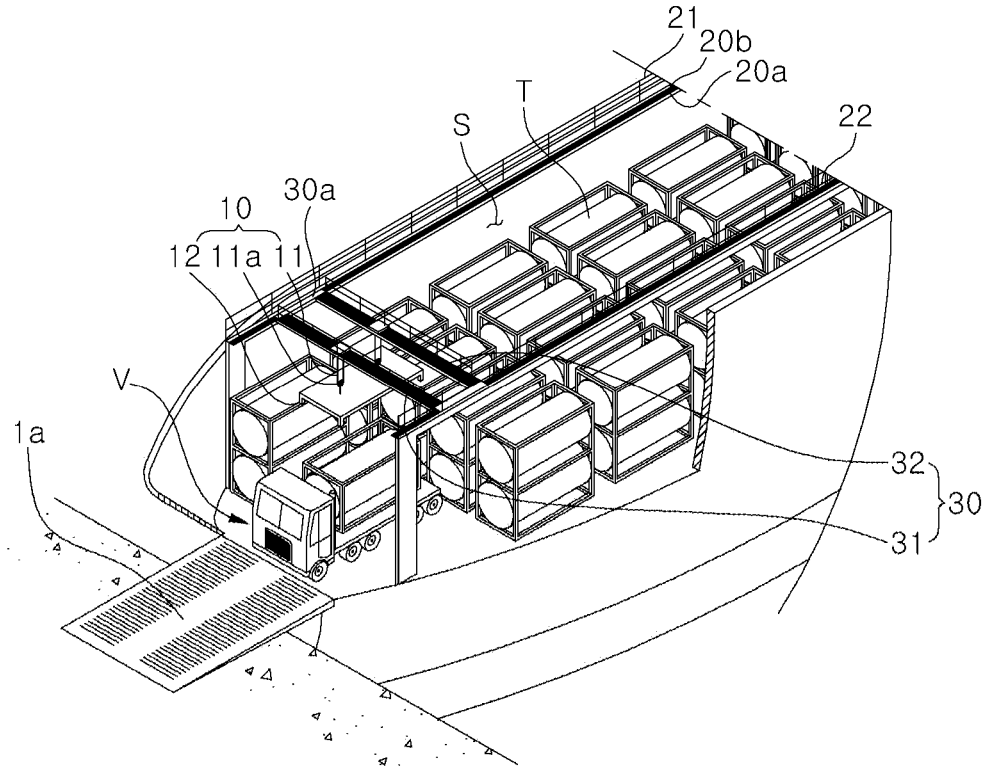

Then, as shown in FIG. 10, after the container is stably seated on the external vehicle V, the holding unit 12 of the crane 10 is separated from the container and lifted up to an upper end of the crane 10 to be returned to an initial position.

Figure 11:
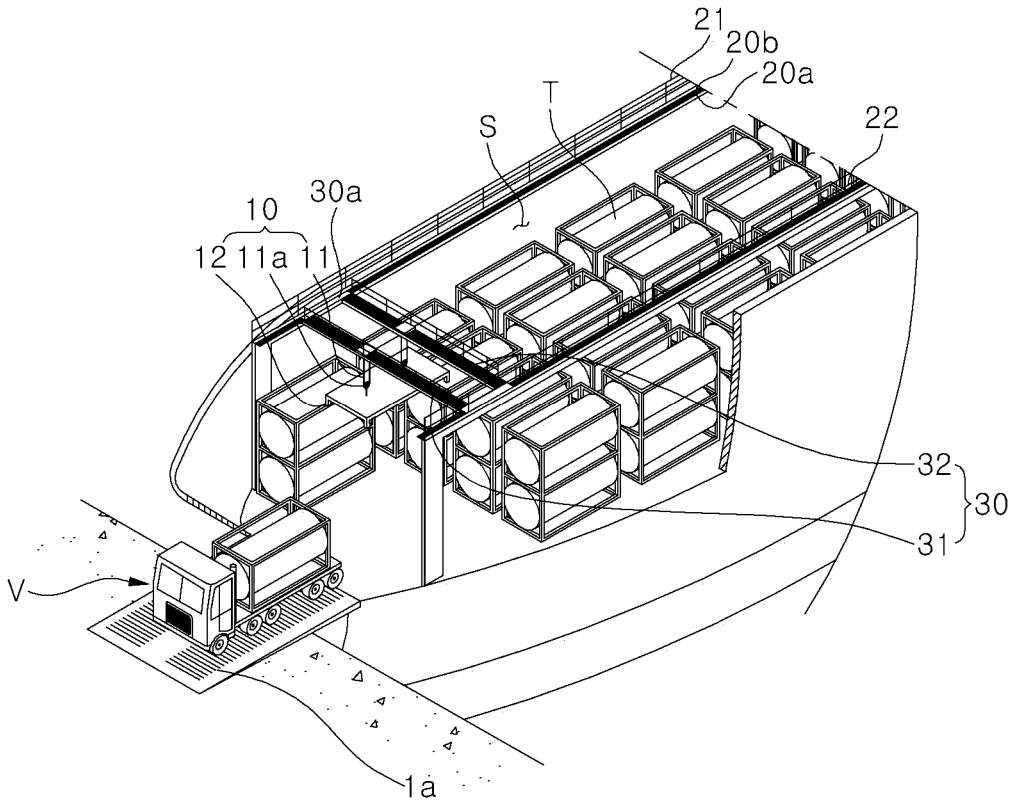

Then, as shown in FIG. 11, the container is transferred by the external vehicle V, and the crane 10 is moved to a next target container. Then, the external vehicle V exits the ship, and the cargo door la at the stem of the ship is closed, thereby completing the container unloading procedure.

Through repetition of this procedure, the containers T can be transported from the cargo compartment S of the ship 1 to demand areas such as an island or the like by the external vehicle V.

Similarly, the LNG tank containers can be transported to the transport ship by the external vehicle V and properly loaded in the cargo compartment in the transport ship to be shipped to other areas.

Here, the LNG tank container T transportation method as shown in FIGS. 5 to 11 is performed using the LNG tank container T transport ship 1 as shown in FIGS. 1 to 4. Thus, detailed description of corresponding components will be omitted for clarity.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

Therefore, the scope of the present invention should be defined by the appended claims and equivalents thereof.

[List of Reference Numerals]

| | |
|---|---|
| 1: Transport ship | 10: Crane |
| 11: Vertical drive unit | 11a: Pulley |
| 12: Holding unit | 20: Primary conveying frame |
| 20a: Protrusion plate | 20b: Conveying rail |
| 21: First primary conveying frame | 22: Second primary conveying frame |
| 30: Secondary conveying frame | 30a: Movable member |
| 31: First secondary conveying frame | 32: Second secondary conveying frame |
| S: Internal cargo compartment | T: LNG tank container |
| V: External vehicle | 1a: Cargo door |

The invention claimed is:

1. An LNG tank container transport ship, comprising:

a cargo compartment disposed in the ship and configured to house a plurality of LNG tank containers containing LNG;

a loading-unloading position disposed in the cargo compartment and configured to permit an external vehicle to come in from outside the ship for loading and unloading at least one of the plurality of LNG tank containers at the loading-unloading position;

a crane located in the cargo compartment and configured to move the at least one LNG tank container inside the cargo compartment, wherein the crane comprises a holding unit configured to hold the at least one LNG tank container and a vertical drive unit configured to move the at least one LNG tank container upward and downward;

at least one primary conveying frame configured to guide the crane to move in a first direction on a horizontal plane; and at least one secondary conveying frame connected to the primary conveying frame and configured to guide the crane to move in a second direction on the horizontal plane, the second direction intersecting the first direction.

2. The LNG tank container transport ship according to claim 1, wherein the primary conveying frame comprises a first primary conveying frame formed at one side of the cargo compartment and a second primary conveying frame formed at the other side of the cargo compartment to be spaced apart from and parallel to the first primary conveying frame, and the secondary conveying frame comprises a first secondary conveying frame and a second secondary conveying frame spaced parallel to each other between the first primary conveying frame and the second primary conveying frame.

3. The LNG tank container transport ship according to claim 2, wherein the crane comprises the vertical drive unit coupled to the first secondary conveying frame and the second secondary conveying frame and is configured to move in the second direction along the first secondary conveying frame and the second secondary conveying frame, and wherein the first secondary conveying frame and the second secondary conveying frame are configured to move in the first direction, intersecting the second direction, along the first primary conveying frame and the second primary conveying frame.

4. The LNG tank container transport ship according to claim 3, wherein each of the first primary conveying frame and the second primary conveying frame comprises a protrusion plate inwardly protruding therefrom and a conveying rail formed on an upper surface of the protrusion plate, and each of the first secondary conveying frame and the second secondary conveying frame comprises a roller formed at both ends thereof, the roller being seated on the conveying rail to be movable in the first direction along the first and second primary conveying frames.

5. The LNG tank container transport ship according to claim 1, wherein the vertical drive unit comprises a pulley to vertically drive the holding unit.

6. A method of operating an LNG tank ship for transporting LNG tank containers, the method comprising:

moving a crane along a primary conveying frame formed in a first direction on a horizontal plane or a secondary conveying frame formed in a second direction intersecting the first direction to transfer the LNG tank containers in a cargo compartment of the LNG tank ship for loading the LNG tank containers containing LNG;

holding, by the crane, at least one LNG tank container in the cargo compartment;

moving the held LNG tank container to a bed of an external vehicle placed in a loading/unloading position in the cargo compartment; and loading the held LNG tank container onto the bed of the external vehicle to be transported to the outside of the LNG tank ship by the external vehicle.

7. The method according to claim 6, wherein the primary conveying frame comprises a first primary conveying frame formed at one side of the cargo compartment and a second primary conveying frame formed at the other side of the cargo compartment to be spaced apart from and parallel to the first primary conveying frame, and the secondary conveying frame comprises a first secondary conveying frame and a second secondary conveying frame spaced parallel to each other between the first primary conveying frame and the second primary conveying frame.

8. The method according to claim 7, wherein the crane comprises a vertical drive unit coupled to the first secondary conveying frame and the second secondary conveying frame and vertically driving the crane, is moved in the second direction on a horizontal plane along the first secondary conveying frame and the second secondary conveying frame, and is moved in the first direction on the same horizontal plane, intersecting the second direction, along the first primary conveying frame and the second primary conveying frame.

9. The method according to claim 6, wherein holding comprises:

moving, by a vertical drive unit, a holding unit of the crane downward to hold the LNG tank container; and lifting up, by the vertical drive unit, the held LNG tank container.

10. The method according to claim 9, wherein the vertical drive unit comprises a pulley to vertically drive the holding unit.

* * * * *